United States Patent [19]

Asano et al.

[11] Patent Number: 4,473,454

[45] Date of Patent: Sep. 25, 1984

[54] CATHODE FOR ELECTROLYSIS OF ACID SOLUTION AND PROCESS FOR THE PRODUCTION THEREOF

[75] Inventors: Hiroshi Asano, Chiba; Takayuki Shimamune, Tokyo; Toshiki Goto, Kanagawa; Masashi Hosonuma, Kanagawa, all of Japan

[73] Assignee: Permelec Electrode Ltd., Kanagawa, Japan

[21] Appl. No.: 508,752

[22] Filed: Jun. 28, 1983

[30] Foreign Application Priority Data

Jun. 30, 1982 [JP] Japan ..... 57-111778

[51] Int. Cl.[3] ..... C25B 11/00

[52] U.S. Cl. ..... 204/290 R; 204/290 F; 427/34; 427/123; 427/376.6; 427/423

[58] Field of Search ..... 204/290 R, 290 F, 292; 427/34, 123, 376.6, 423

[56] References Cited

U.S. PATENT DOCUMENTS

| | | | |
|---|---|---|---|
| 4,175,023 | 11/1979 | Arqade | 204/252 |
| 4,210,501 | 7/1980 | Dempsey | 204/129 |
| 4,295,951 | 10/1981 | Bommaraju | 204/290 F |

*Primary Examiner*—John F. Niebling

*Attorney, Agent, or Firm*—Sughrue, Mion, Zinn, Macpeak and Seas

[57] ABSTRACT

A cathode for use in the electrolysis of acid solutions, comprising an electrically conductive substrate, a sprayed coating layer containing at least 10% by weight of W, WC or a mixture thereof on the substrate and an impregnated coating layer comprising a mixture of a cathode active substance and an acid-resistant fluorine-based resin on the external surface of the sprayed coating layer, and a process for the production of such a cathode. The cathode has very superior hydrogen overvoltage characteristics and durability, and is very suitable for use in the electrolysis of acid solutions.

9 Claims, No Drawings

CATHODE FOR ELECTROLYSIS OF ACID SOLUTION AND PROCESS FOR THE PRODUCTION THEREOF

FIELD OF THE INVENTION

The present invention relates to a cathode for electrolysis of acid solutions and to a process for the production thereof. More particularly, the present invention relates to a cathode for electrolysis of organic or inorganic acid solutions, comprising a metallic substrate, a sprayed coating layer of a cathod substance composed mainly of tungsten (W), tungsten carbide (WC) or a mixture thereof, and an impregnated coating layer of a mixture of a cathode active substance and an acid-resistant fluorine-based resin, and to a process for the production thereof. The cathode shows excellent durability.

BACKGROUND OF THE INVENTION

Heretofore, graphite has been commonly used as a cathode for electrolysis of acidic electrolytes comprising hydrochloric acid, sulfuric acid, organic acids or mixtures threof. Although graphite is inexpensive and has superior corrosion resistance and hydrogen brittle resistance, it has disadvantages in that the hydrogen generation potential is high, the electrical conductivity is relatively low, and the mechanical strength and workability are poor. To overcome these problems, various attempts have been made: for example, East German Pat. No. 62,308 discloses a method of plasma flame spraying tungsten carbide or titanium carbide on graphite to produce a cathode having a low hydrogen overvoltage and to reduce the electrolytic voltage. This method, however, fails to overcome the problems involved in using graphite as a cathode substrate.

Various cathodes are also known, which comprise a metallic substrate and a coating layer on the substrate, the coating layer being composed of a substance having a low hydrogen overvoltage. For example, Japanese Patent Application (OPI) No. 32832/77 (the term "OPI" as used herein means a "published unexamined Japanese patent application") discloses a cathode for the electrolysis of chlorine/alkalis which is prepared by spray coating an iron-base metal substrate with a powdery metal having a low hydrogen overvoltage. These cathodes have improved mechanical strength and workability because metals are used as their substrates. However, use of these cathodes in the electrolysis of chlorine/alkalis wherein the cathode electrolyte is alkaline is intended. When these are used as cathodes for the electrolysis of the above-described acid solution, they suffer from various disadvantages in that they have insufficient corrosion resistance and are not durable for practical use.

A cathode for the electrolysis of acid solutions comprising an electrically conductive metallic substrate, a sprayed coating layer of a cathode active substance containing W, WC or a mixture thereof, and an impregnated coating layer of an acid-resistant fluorine-based resin, where the impregnated coating layer is provided on the external surface of the sprayed coating layer (see Japanese Patent Application No. 148698/81 (corresponding to U.S. patent application Ser. No. 416,512, filed Sept. 9, 1982 abandoned) has already been developed.

SUMMARY OF THE INVENTION

The present invention is intended to further improve the above-described cathode for the electrolysis of acid solutions and is characterized by using a mixture of a cathode active substance and an acid-resistant fluorine-based resin in place of the acid-resistant fluorine-based resin alone.

An object of the invention is to provide a cathode for the electrolysis of acid solutions, having excellent mechanical strength and workability, and specially low hydrogen overvoltage characteristics, and showing excellent durability.

Another object of the invention is to provide a process for the production of such cathodes having excellent electrode characteristics.

The present invention provides:

(1) a cathode for the electrolysis of acid solutions, comprising an electrically conductive substrate, a sprayed coating layer containing at least 10% by weight of W, WC, or a mixture thereof on the substrate, and an impregnated coating layer of a mixture of a cathode active substance and an acid-resistant fluorine-based resin, the impregnated coating layer being provided on the external surface of the sprayed coating layer; and (2) a process for producing a cathode for the electrolysis of acid solutions, which comprises spraying a powder containing at least 10% by weight of W, WC, or a mixture thereof onto an electrically conductive substrate to form a sprayed coating layer, and then, impregnating the external surface of the sprayed coating layer with a mixture of a cathode active substance powder and an acid-resistant fluorine-based resin and heat solidifying the mixture to form an impregnated coating layer.

DETAILED DESCRIPTION OF THE INVENTION

Metallic substrates which can be used herein can be made of various known metals having good electrical conductivity and corrosion resistance. Of these metals, Ti, Ta, Nb, Zr, and alloys containing them as a major component (such as Ti—Ta, Ti—Ta—Nb, etc.) and Ni and its alloys (such as Ni—Cu, Ni—Mo, etc.) are preferred. These substrates can be worked into any desired shape, e.g., a plate, a porous plate, a bar-like member, a lattice-like member, and a net-like member, because they are made of metal.

The cathode substance composed mainly of W, WC or a mixture thereof is then sprayed on the metallic substrate to form a sprayed coating layer. W, WC and mixtures thereof have low hydrogen overvoltage characteristics as a cathode substance. When W, WC or a mixture thereof is coated on a substrate by spraying, a suitably coarsened surface is produced and the surface area is increased. Therefore, the formation of a sprayed coating layer of W, WC or a mixture thereof provides the effect of further decreasing the hydrogen generating potential as a cathode. Furthermore, since W, WC and mixtures thereof have excellent corrosion resistance and hydrogen brittleness resistance, are durable for long-term use, and, at the same time, become a protective coating for metals of the substrate in the electrolysis of acid solutions, they also have the effect of increasing the durability of the resulting cathode.

The cathode substance being sprayed must contain at least 10% by weight of W, WC, or a mixture thereof. In proportions less than 10% by weight, the effects of decreasing the hydrogen overvoltage and of increasing the durability can be obtained only insufficiently, and the resulting cathode is not suitable for practical use. The W, WC or mixture thereof may be present in an amount of up to 100%.

As these W and WC components, those commercially available as spraying powders can be used. WC for spraying usually contains metals, such as Co, Ni, Cr, B, Si, Fe, and C, which improve the sintering properties at spraying. Typical WC compositions which can be used are shown in Table 1 below.

TABLE 1

| WC Powder for Flame Spraying | | | | | | | | |
|---|---|---|---|---|---|---|---|---|
| | Component (% by Weight) | | | | | | | |
| No. | WC | Co | Ni | Cr | B | Si | Fe | C |
| 1 | 70.4 | 9.6 | 14.0 | 3.5 | 0.8 | 0.8 | 0.8 | 0.1 |
| 2 | 44.0 | 6.0 | 36.0 | 8.5 | 1.65 | 1.95 | 1.5 | 0.45 |
| 3 | 30.8 | 42.0 | 46.0 | 11.0 | 2.5 | 2.5 | 2.5 | 0.5 |
| 4 | 88 | 12 | — | — | — | — | — | — |
| 5 | 83 | 17 | — | — | — | — | — | — |

W is commercially available in the form of a powder. This W powder can be used alone, or a suitable amount of W powder can be mixed with a WC powder for spraying as described in Table 1 and used. A suitable grain diameter for the powder is about 1 to about 100μ, preferably 10 to 50μ. Materials such as Co, Ni, Cr, Mo and C can be present in an amount of up to 90% by weight.

Platinum group metals, i.e., Pt, Ru, Ir, Pd, and Rh, or their oxides, e.g., $RuO_2$, $IrO_2$, etc., can be added to or deposited on the sprayed coating layer of the cathode substance. The amount of such components added is up to 90% by weight, preferably from 0.01 to 10% by weight, and their grain diameter preferably ranges from about 0.1μ and 0.1 mm. Addition or deposition of these platinum group metals or their oxides even in small amounts is very effective in decreasing the hydrogen overvoltage. Furthermore, such permits the reduction of the hydrogen generating potential by from about 0.2 to 0.5 V. These platinum group metals are expensive, and the above-described effects can be sufficiently obtained when they are present merely in the surface layer. For this reason, spraying of the platinum group metals or oxides is preferably performed last. Furthermore, after the formation of the above-described sprayed coating layer of W, WC or a mixture thereof, the platinum group metals or oxide may be deposited thereon by techniques such as electroplating, chemical plating, dispersion plating, sputtering, vacuum deposition, thermal decomposition, or sintering.

The thickness of the sprayed coating layer is preferably from about 0.02 to 0.5 mm. When the thickness is less than 0.02 mm, it is difficult to form a uniform coating layer on the substrate, and the desired performance cannot be obtained. On the other hand, when the thickness is more than 0.5 mm, the coating layer is easily cracked, and there is the danger of the corrosion resistance being deteriorated.

Spraying can be performed by any of flame spraying or plasma spraying. A commercially available spraying apparatus for the exclusive use of powder can be used.

The thus-prepared cathode member comprising a metallic substrate and a sprayed coating layer formed on the substrate has fairly improved cathode characteristics and durability as such. Therefore, in cases in which corrosion conditions are moderate, the cathode member as such is sufficiently durable for practical use. In general, however, a number of fine pores are inevitably formed in the sprayed coating layer, and electrolyte penetrates through these fine pores. Therefore, in acidic electrolytes which are highly corrosive, there is the danger of a corrosion of the substrate. Heretofore, a cathode sufficiently durable to such corrosion has not been obtained.

In accordance with this invention, a mixture of a cathode active substance and an acid-resistant fluorine-based resin is deposited on the above-prepared sprayed coating layer to form an impregnated coating layer. This is based on our findings that the formation of such impregnated coating layers greatly increases the durability of the resulting cathode, and that the incorporation of cathode active substances enables particularly low hydrogen overvoltage characteristics to be maintained.

Various acid-resistant fluorine-based resins conventionally known can be used in the invention. Of these fluorine-based resins, an ethylene tetrafluoride resin, an ethylene fluorochloride resin, an ethylene tetrafluoride/propylene hexafluoride copolymer resin, and the like are preferred.

As cathode active substances which are used in combination with the above-described acid-resistant fluorine-based resins to form the impregnated coating layer, those substances which have a low hydrogen overvoltage as a cathode substance, and corrosion resistance can be used. Particularly preferred cathode active substances include platinum group metals such as Pt, Rh, Pd, Ru, and Ir, and their alloys (e.g., Pt—Rh, Pt—Ru, Pt—Pd, etc.) and oxides (e.g., $Rh_2O_3$, PdO, $RuO_2$, $IrO_2$, etc.). They can be used alone or in combination with each other. Furthermore, they may be deposited or coated on activated carbon, valve metals, such as Ti, Ta, Nb, and Zr, and their alloys (e.g., Ti—Ta, Ti—Nb, Ti—Zr—Ta, etc.) W, WC, or the like.

These cathode active substances are preferably in the form of a powder so that they can be uniformly mixed with the acid-resistant fluorine-based resin. The size of such cathode active substance powder can range usually from about 0.1 to 200μ and preferably from about 0.1 to 50μ and the fluorine-based resin in powder form can have a particle size of about 0.1 to about 100μ. Although the ratio of cathode active substance to acid-resistant fluorine-based resin is not critical, the cathode active substance can be employed in a proportion of from about 10 to 90% by weight and preferably from about 30 to 70% by weight, within which range the desired reduction in hydrogen overvoltage and mechanical strength are sufficiently obtained.

The acid-resistant fluorine-based resin in the mixture, when deposited on the sprayed coating layer, acts to seal the fine pores in the sprayed coating layer, and prevents very efficiently the corrosion of the substrate due to the penetration of electrolyte through the fine pores.

The formation of the impregnated coating layer is preferably performed so that the pores in the sprayed coating layer are sufficiently sealed, but so that the cathode active surface is insufficiently covered, allowing an adequate amount of exposed areas of the cathode substance to remain. This can be easily achieved by coating a predetermined amount of a dispersion comprising the above-described fluorine-based resin and cathode active substance powder on the sprayed coating layer by techniques such as spraying and brush coating, and heating such at a temperature of from about 300° to 400° C. The impregnation-deposition of the fluorine-based resin mixture can also be performed by techniques such as a plasma polymerization method, a plasma spraying method, a vacuum deposition method, an electrodeposition method, and by merely rubbing the surface with the resin/cathode activating substance mixture.

It is preferred for the acid-resistant fluorine-based resin to be provided on the external surface of the sprayed coating layer in an amount of at least about 1 $g/m^2$. In amounts less than about 1 $g/m^2$, the amount of the cathode consumed increases abruptly, and the effect of increasing the corrosion resistance is obtained only insufficiently. On the other hand, when the amount provided is increased, although the resulting corrosion resistance is very satisfactory, the exposed cathode active surface is decreased, resulting in a gradual increase in the hydrogen generating potential. For this reason, it is preferred for the resin to be provided in such amounts that the cathode active substance is sufficiently exposed as described above.

The cathode of the invention can be used in a bipolar electrode as well as in a monopolar electrode electrolysis.

The following examples are given to illustrate the invention in greater detail. Unless otherwise indicated, all parts, ratios, percents and the like are by weight.

EXAMPLE 1

On a round bar of titanium (diameter: 3 mm; length: 20 cm) was plasma sprayed WC 12%-Co powder (METCO 72F-NS, produced by Metco, Inc.) (No. 4 in Table 1) under the conditions shown in Table 2 below to form a 0.1 mm thick sprayed coating layer.

TABLE 2

| WC Spraying Conditions | |
|---|---|
| Arc Current | 500 A |
| Arc Voltage | 75 V |
| Amount of Operation Gas Supplied | |
| Ar | 40 l/min |
| $H_2$ | 6 l/min |
| Amount of Powder Supplied | 2.7 kg/hr |
| Spray Distance | 90 mm |

Then, a fluorine-based resin mixture containing platinum black as a cathode active substance, this formulation being shown in Table 3 below, was sprayed on the above-prepared sprayed coating layer and heated in an argon atmosphere at 330° C. for 30 minutes.

TABLE 3

| Formulation of Platinum Black/Fluorine-based Resin Mixture | |
|---|---|
| Platinum Black (produced by Tanaka Mathey Co., Ltd.) | 0.5 g |
| Ethylene Tetrafluoride Resin (trade name: Polyflon Dispersion D-1; produced by Daikin Kogyo Co., Ltd.) | 1.3 ml |
| Distilled Water | 1.5 ml |

A cross section of the thus-produced cathode was examined with an optical microscope. This metallographic examination confirmed that the cathode active substance layer was formed uniformly in a thickness of about 0.1 mm on the uniform sprayed coating layer of WC.

Using the cathode, the potential was measured at 25° C. in a 150 g/l aqueous solution of hydrochloric acid, and it was found that the hydrogen overvoltage was 150 mV at a current density of 0.3 $A/cm^2$. To test the durability of the cathode, electrolysis was performed in a 150 g/l aqueous solution of hydrochloric acid at 60° C. and a current density of 0.5 $A/cm^2$. Even after the passage of 200 hours or more, no consumption of the cathode was observed at all.

COMPARATIVE EXAMPLE 1

For comparison, a cathode was produced in the same manner as in Example 1 above with the exception that the cathode active substance/resin mixture was not deposited on the WC—Co sprayed coating layer, and this cathode was tested in the same manner as in Example 1. With this comparative cathode, the hydrogen overvoltage was 220 mV, and the amount of the cathode consumed after the electrolysis for 200 hours reached 60 $g/m^2$.

Thus, it can be seen that the cathode of the invention is greatly superior in hydrogen overvoltage characteristics and durability.

EXAMPLE 2

A cathode was produced in the same manner as in Example 1 except that Pt deposited on activated carbon was used as a cathode active substance. This cathode active substance was prepared from activated carbon (trade name: SD; produced by Hokuetsu Tanso Co., Ltd.) and platinous chloride by the known formaldehyde reduction method (see *Denki Kagaku*, Vol. 46, No. 12, pp. 656–660 (1978)).

The thus-produced cathode was tested in the same manner as in Example 1. The hydrogen overvoltage was 170 mV, and even when the cathode was used in electrolysis for 200 hours or longer, no consumption of the cathode was observed at all.

EXAMPLE 3

On a 30 mm×30 mm×2 mm nickel-base alloy plate (Ni-28% Mo-5% Fe; trade name: Hastelloy B, produced by Mitsubishi Metal Co., Ltd.) was plasma sprayed commercially available W powder (METCO 61-FNS, produced by Metco, Inc.) under the conditions shown in Table 4 below to form a 0.1 mm thick sprayed coating layer.

TABLE 4

| W Spraying Conditions | |
|---|---|
| Arc Current | 500 A |
| Arc Voltage | 7.5 V |
| Amount of Operation Gas Supplied | |
| $N_2$ | 40 l/min |
| $H_2$ | 6 l/min |
| Amount of Powder Supplied | 5 kg/hr |
| Spray Distance | 100 mm |

Using a Ti—$RuO_2$ powder as a cathode active substance, this powder being prepared by coating $RuO_2$ on Ti powder (grain size, less than 325 mesh) in a thickness of about 1$\mu$ using a thermal decomposition method, a mixture shown in Table 5 below was prepared.

TABLE 5

| Ti—$RuO_2$ - Resin Mixture | |
|---|---|
| Ti—$RuO_2$ Powder | 1 g |
| Ethylene Tetrafluoride Resin (same as in Table 3) | 1.3 ml |
| Distilled Water | 1.5 ml |

This mixture was then spray-coated on the above-prepared W sprayed coating layer and heated at 330° C. for 30 minutes to prepare a cathode.

The hydrogen overvoltage of the cathode in a 150 g/l aqueous solution of sulfuric acid at 25° C. was 160 mV. The electrolytic test of the cathode was performed in a 150 g/l aqueous solution of sulfuric acid at 50° C. and a current density of 0.2 A/cm$^2$. Even after 1,000 hours, no consumption of the cathode was observed.

COMPARATIVE EXAMPLE 2

For comparison, a cathode produced only by spray coating W on a Ni-base alloy plate as in Example 3 was produced and tested in the same manner as in Example 3. The hydrogen overvoltage was 230 mV, and after 1,000 hours, the amount of the cathode consumed reached 50 g/m$^2$.

While the invention has been described in detail and with respect to various embodiments thereof, it is apparent that various changes and modifications can be made therein without departing from the spirit and scope thereof.

We claim:

1. A cathode for the electrolysis of acid solutions, comprising (a) an electrically conductive substrate, (b) a sprayed coating layer on the substrate (a), said sprayed coating layer containing at least 10% by weight of W, WC, or a mixture thereof, and (c) an impregnated coating layer on the sprayed coating layer (b), said impregnated coating layer being prepared by providing a mixture of a cathode active substance and an acid-resistant fluorine-based resin on the external surface of the sprayed coating layer (b).

2. The cathode as claimed in claim 1, wherein the cathode active substance is a powder of a member selected from the group consisting of Pt, Rh, Pd, Ru, and Ir, and their alloys, oxides, and mixtures thereof.

3. The cathode as claimed in claim 1, wherein the cathode active substance is a powder of a member selected from the group consisting of Pt, Rh, Pd, Ru, and Ir, and their alloys, oxides, and mixtures thereof, each being deposited or coated on activated carbon, Ti, Ta, Nb, Zr, or their alloys, W, or WC.

4. The cathode as claimed in claim 1, wherein the electrically conductive substrate is made of Ti, Ta, Nb, Zr, Ni, or an alloy containing Ti, Ta, Nb, Zr, or Ni.

5. The cathode as claimed in claim 1, wherein the sprayed coating layer comprises at least 10% by weight of W, WC, or a mixture thereof, and up to 90% by weight of at least one member selected from the group consisting of Co, Ni, Cr, Mo, B and C.

6. The cathode as claimed in claim 1 or 5, wherein the sprayed coating layer contains or carries thereon up to 10% by weight of at least one member selected from the group consisting of Pt, Ru, Ir, Pd, and Rh, and their oxides.

7. The cathode as claimed in claim 1, wherein the acid-resistant fluorine-based resin is an ethylene tetrafluoride resin.

8. A process for producing a cathode for the electrolysis of acid solutions, which comprises (a) spraying a powder containing at least 10% by weight of W, WC, or a mixture thereof onto an electrically conductive metallic substrate to form a sprayed coating layer, (b) depositing a mixture of a cathode active substance and an acid-resistant fluorine-based resin on the external surface of the sprayed coating layer and (c) heating and then solidifying the mixture of cathode active substance and fluorine-based resin to form an impregnated coating layer.

9. The process as claimed in claim 8, wherein the sprayed coating layer of step (a) is formed by a plasma spraying method or a flame spraying method.

* * * * *